US010214963B2

(12) United States Patent
Simula et al.

(10) Patent No.: US 10,214,963 B2
(45) Date of Patent: Feb. 26, 2019

(54) ACCESS PLATFORM SYSTEM WITH INTEGRATED FOLDING STEPS

(71) Applicant: GSE TECHNOLOGIES, LLC, Houghton, MI (US)

(72) Inventors: Glen Raymond Simula, Hancock, MI (US); Justin Sven LaCosse, Houghton, MI (US)

(73) Assignee: GSE TECHNOLOGIES, LLC, Houghton, MI (US)

( * ) Notice: Subject to any disclaimer, the term of this patent is extended or adjusted under 35 U.S.C. 154(b) by 4 days.

(21) Appl. No.: 15/182,788

(22) Filed: Jun. 15, 2016

(65) Prior Publication Data

US 2017/0362895 A1 Dec. 21, 2017

(51) Int. Cl.

| | |
|---|---|
| ***E06C 7/16*** | (2006.01) |
| ***E06C 1/387*** | (2006.01) |
| ***E06C 5/04*** | (2006.01) |
| ***E06C 7/18*** | (2006.01) |

(52) U.S. Cl.

CPC ..... *E06C 7/16* (2013.01); *E06C 1/387* (2013.01); *E06C 5/04* (2013.01); *E06C 7/182* (2013.01)

(58) Field of Classification Search

CPC ..... E06C 5/02; E06C 5/04; E06C 9/08; E06C 7/16; E06C 1/39; E06C 1/387; B63B 27/14; A62B 1/02; B60R 3/00

See application file for complete search history.

(56) References Cited

U.S. PATENT DOCUMENTS

| | | | | | |
|---|---|---|---|---|---|
| 2,355,924 | A | * | 8/1944 | Pescara | F02B 71/00 123/46 R |
| 3,237,719 | A | * | 3/1966 | Russell | E06C 1/12 182/103 |
| 3,756,622 | A | * | 9/1973 | Pyle | B60R 3/02 280/166 |
| 3,830,342 | A | * | 8/1974 | Allen | B66F 9/08 187/222 |
| 3,869,022 | A | | 3/1975 | Wallk | |
| 4,020,920 | A | * | 5/1977 | Abbott | B60R 3/02 105/445 |
| 4,110,673 | A | * | 8/1978 | Magy | B60R 3/02 105/444 |

(Continued)

FOREIGN PATENT DOCUMENTS

| | | | |
|---|---|---|---|
| GB | 2523003 | A | 8/2015 |
| KR | 20120133228 | A * | 12/2012 |

(Continued)

*Primary Examiner* — Katherine W Mitchell
*Assistant Examiner* — Candace L Bradford
(74) *Attorney, Agent, or Firm* — Brooks Kushman P.C.

(57) ABSTRACT

An access platform system for enabling access to and from ground-based structures, vehicles, and mobile equipment. The system has a main frame with walls that is attached to or juxtaposed with the ground-based structures, vehicles, and mobile equipment; a vertical platform displacement assembly attached to the main frame; and a folding steps assembly. The vertical displacement mechanism has left and right intermediate carriage assemblies, and left and right lift cylinders with a multi-stage apparatus for influencing the stroke of the lift cylinders. In one embodiment, the folding steps assembly has an electromechanical means for folding and unfolding the steps.

5 Claims, 15 Drawing Sheets

(56) References Cited

U.S. PATENT DOCUMENTS 4,124,099 A * 11/1978 Dudynskyj ..... B60P 1/4414 280/166
4,164,292 A * 8/1979 Karkau ..... B60R 3/02 105/448
4,264,084 A * 4/1981 Telles ..... B60R 3/02 182/115
4,618,030 A * 10/1986 Campbell ..... E06C 7/16 182/121
4,642,953 A * 2/1987 DeGood ..... E04F 11/06 52/183
5,033,582 A 7/1991 Hoben
5,316,432 A * 5/1994 Smalley ..... B60R 3/02 187/200
5,425,615 A * 6/1995 Hall ..... B60P 1/4421 105/447
5,549,312 A * 8/1996 Garvert ..... B60R 3/02 280/166
5,674,043 A * 10/1997 Dorn ..... A61G 3/06 187/222
5,813,494 A 9/1998 Ulschmid et al.
5,988,316 A 11/1999 Hedley
6,109,395 A * 8/2000 Storm ..... B66B 9/0869 187/200
6,347,686 B1 2/2002 Hedley et al.
7,080,715 B1 * 7/2006 Bowlin ..... B25H 5/00 182/116
7,870,932 B2 1/2011 Lapke et al.
8,261,880 B1 9/2012 Hop
8,397,868 B1 * 3/2013 Ferree ..... E06C 9/08 182/116
8,668,048 B1 3/2014 Morris
D713,772 S * 9/2014 Ziaylek ..... D12/203
8,919,497 B2 12/2014 Rund
2001/0050044 A1 * 12/2001 Mueller ..... B05B 16/40 118/324
2003/0173152 A1 * 9/2003 Schmid, Jr. ..... E04F 11/002 182/84
2004/0154523 A1 * 8/2004 Arias ..... B63B 7/08 114/343
2006/0272895 A1 * 12/2006 Lavoie ..... B60R 3/02 182/127
2008/0053750 A1 * 3/2008 Tseng ..... A62B 1/02 182/82
2010/0122871 A1 * 5/2010 Gottlinger ..... B60R 3/007 182/106
2012/0181109 A1 7/2012 Rund
2014/0291071 A1 * 10/2014 Conde, Jr. ..... A62B 1/00 182/70
2015/0060198 A1 * 3/2015 Horn ..... A62B 1/02 182/48

FOREIGN PATENT DOCUMENTS

WO WO 2015119505 A1 * 8/2015 ..... E06C 9/08
WO WO-2015119505 A1 * 8/2015 ..... E06C 7/12

* cited by examiner

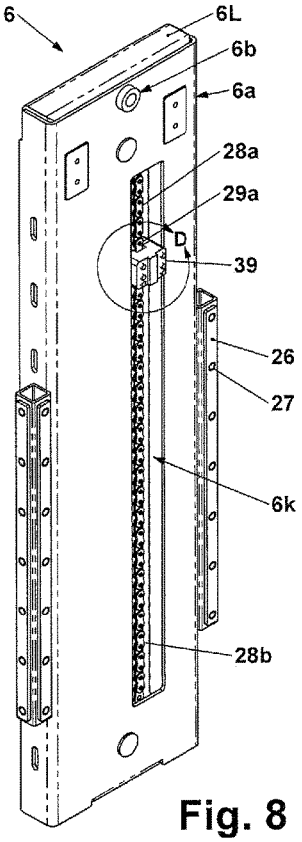
Fig. 8
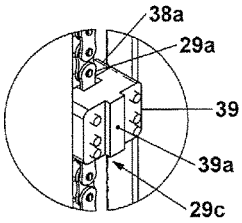
Fig. 8D
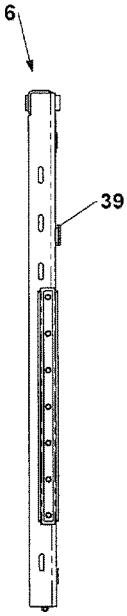
Fig. 8A
Fig. 8C
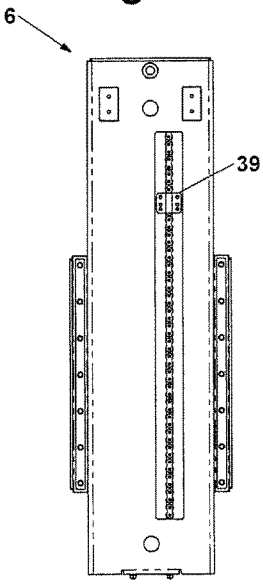
Fig. 8B 47
47e
47d
47e
47b
47f
47c
47a
47b
54
53
54
46e
46c
46
47g
49b
46g
46i
49
46i
51
50
46

49
49
52
50
46h
46

49
46g
B
49a
A
46h
46b
46f
54
53
54
48g
48b
48
48b
48e
48f
48e
48d
48c
48a

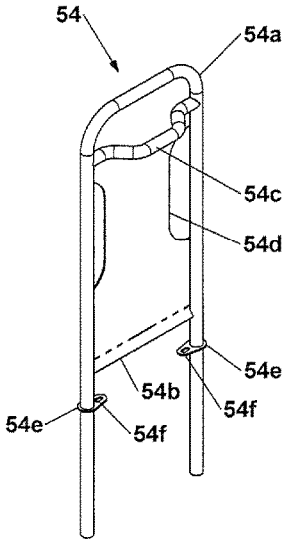
Fig. 13
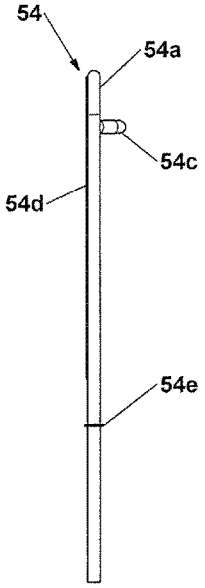
Fig. 13A
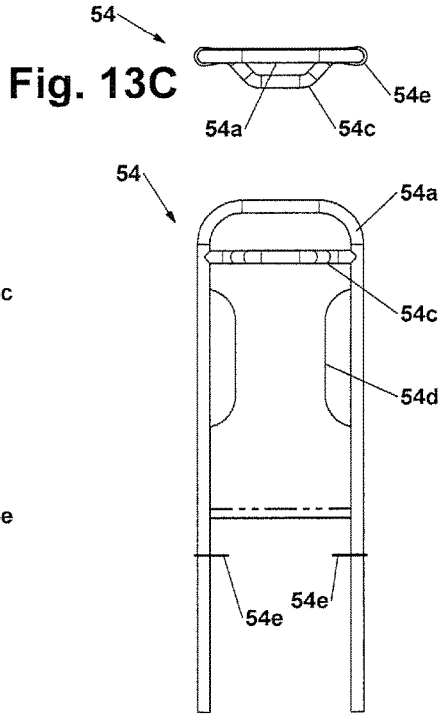
Fig. 13C
Fig. 13B

ACCESS PLATFORM SYSTEM WITH INTEGRATED FOLDING STEPS

FIELD OF THE INVENTION

This disclosure relates to a platform system that provides ease of access to elevated decks, vehicle control cabs, and similar areas of industrial vehicles and mobile equipment and ground-based structures by workers, machine operators and other personnel.

BACKGROUND OF THE INVENTION

In the industrial and mobile equipment industries, accidents happen following slips and falls from steps, ladders and stairways. It would be desirable to reduce accident rates by deploying platform systems that enable safe passage into and from large industrial and mobile equipment ground-based structures and machines.

The art considered before filing this application includes U.S. Pat. Nos. 3,869,022; 5,033,582; 5,813,494; 5,988,316; 6,347,686; 7,870,932; 8,261,880; 8,668,048; 8,919,497; U.S. Pub. No. 2012/0181109 and Great Britain Pan access platform systematent No. GB 2523003.

SUMMARY OF THE INVENTION

The scope of this disclosure includes and is not limited to platform systems that are adapted for use with train locomotives, large mining and construction haul trucks, loaders, earth moving equipment, large agricultural logging industry equipment, aviation ground service equipment and other vehicle applications and ground-based structures, plus naval marine applications related to large ships and vessels; this term also includes stationary structures or buildings (collectively referenced herein as "equipment").

One aspect of the present disclosure involves an access platform system (referenced herein as "access platform system") that, to enable access to the equipment rises or lowers in relation to the equipment. The access platform system has integrated folding steps supported by a mainframe that is attached or juxtaposed to the equipment to further facilitate the ingress and egress of personnel into and out from the equipment. Generally the main frame supports two mechanisms:

a first mechanism which in one embodiment comprises a lifting or lowering mechanism (collectively referenced herein as "vertical displacement mechanism"; this term is meant to be construed as vertical, sloped or inclined, but for brevity herein, the term "vertical" is used) which in one embodiment has a rising and lowering platform assembly on which personnel may stand or ride for the purpose of raising them to an elevated level and lowering them to a lower level or ground level; and a second mechanism which in one embodiment includes a folding steps assembly that may be stored in a compact and efficient folded-up configuration during use of the access platform system, or otherwise optionally deployed and folded for access to equipment by personnel when the access platform system is not being used.

BRIEF DESCRIPTION OF THE DRAWINGS

FIG. 8 is a front upper left perspective view of a right intermediate carriage assembly also shown in FIGS. 1 through 4;

FIG. 8A is a front view of the right intermediate carriage assembly shown in FIG. 7;

FIG. 8B is a right side view of the right intermediate carriage assembly shown in FIG. 8;

FIG. 8C is a top view of the right intermediate carriage assembly shown in FIG. 8;

FIG. 8D is a detailed view of the right intermediate carriage assembly shown in FIG. 8;

FIG. 13 is a front upper left perspective view of a left handrail assembly also shown in FIGS. 1 through 4 and 10;

FIG. 13A is a front view of the left handrail shown in FIG. 13.

FIG. 13B is a right side view of left handrail shown in FIG. 13.

FIG. 13C is a top view of the left hand rail shown in FIG. 13.

DESCRIPTION OF THE PREFERRED EMBODIMENTS

Figure 1:
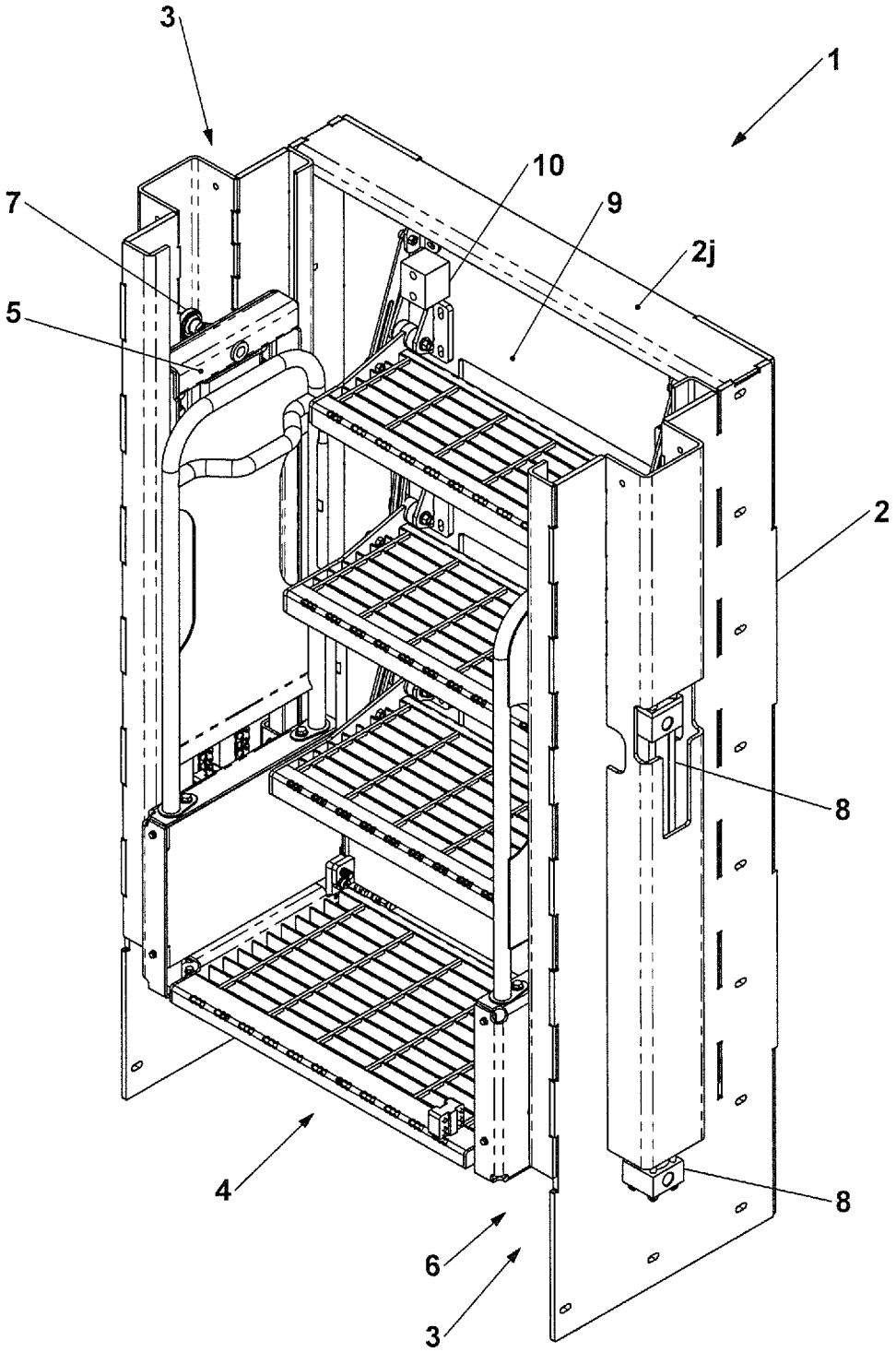
FIG. 1 is a three-quarter upper left front perspective view of an access platform system, a vertical displacement mechanism, and a folding steps assembly in accordance with one embodiment of the present disclosure.
Figure 2B:
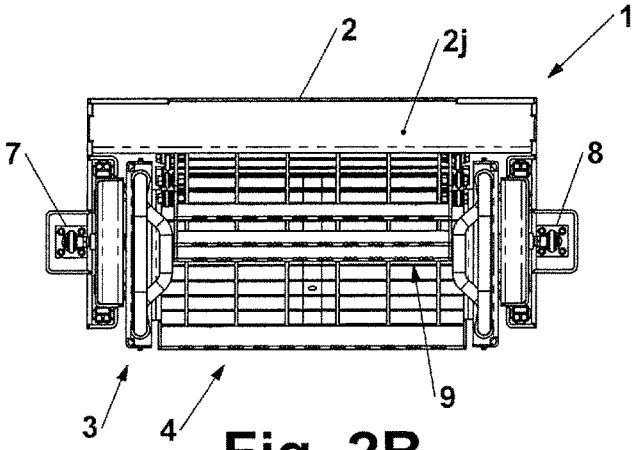
FIG. 2B is a top view of the embodiment shown in FIG. 1.
Figure 2:
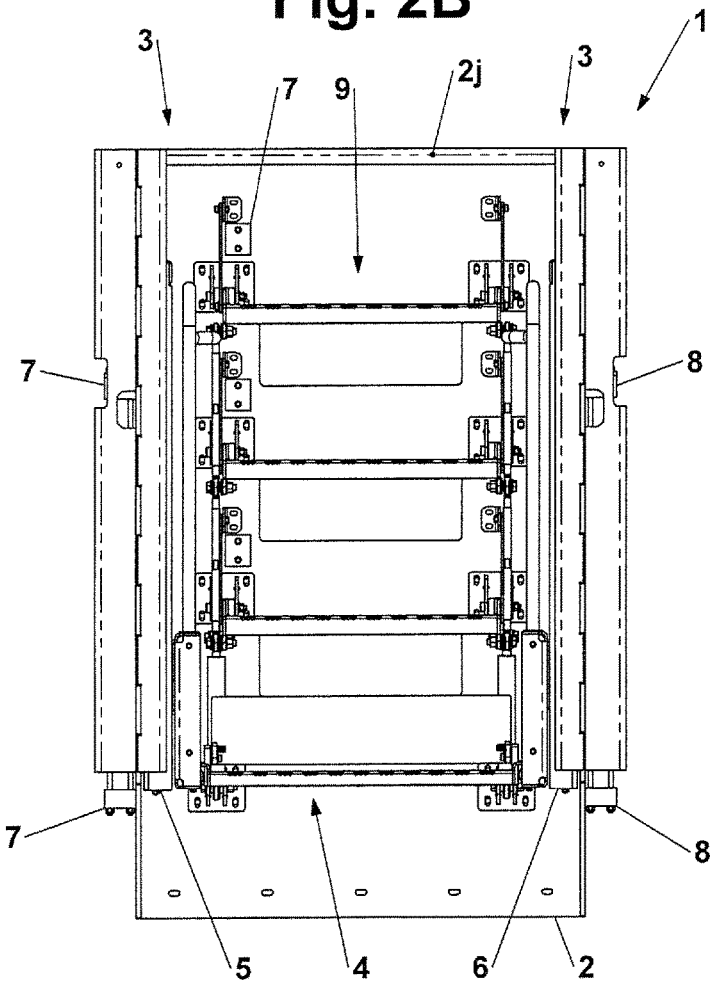
FIG. 2 is a front view of the embodiment shown in FIG. 1.
Figure 2A:
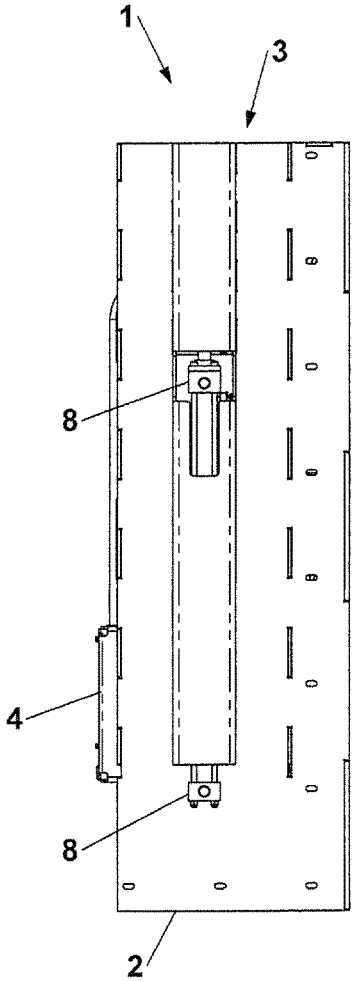
FIG. 2A is a right side view of the embodiment shown in FIG. 1.

Referring to the drawings and the illustrative embodiments depicted therein, FIGS. 1 through 4 depict an embodiment of a rising and lowering platform vehicle or structure access system 1 ("access platform system") with a folding steps assembly 9. In one embodiment, the access platform system has a main frame 2 that supports two cooperating mechanisms.

Figure 3:
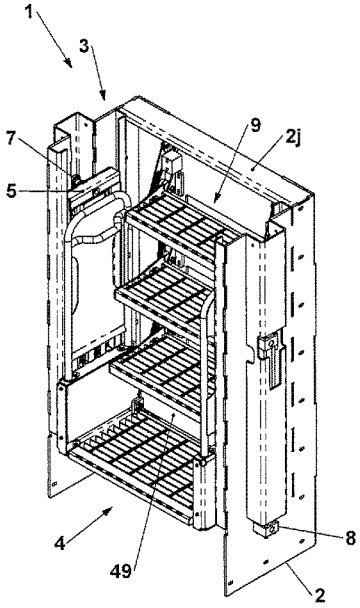
FIG. 3 resembles FIG. 1 but is of a smaller scale to facilitate a side-by-side comparison with FIGS. 3A & 3B.
Figure 6:
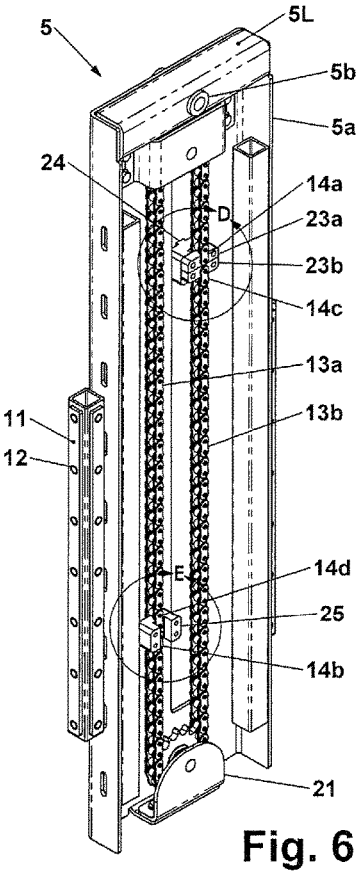
FIG. 6 is a front upper left perspective view of a left intermediate carriage assembly shown in FIGS. 1 through 4.
Figure 6D:
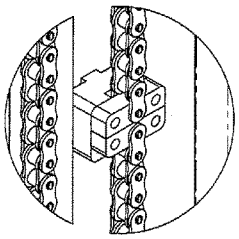
FIG. 6D is a detailed view of the left intermediate carriage assembly shown in FIG. 6.
Figure 6E:
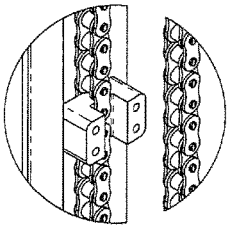
FIG. 6E is a detailed view of the left intermediate carriage assembly shown in FIG. 6.
Figure 6C:
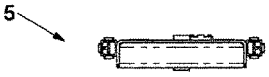
FIG. 6C is a top view of the left intermediate carriage assembly shown in FIG. 6.
Figure 6A:
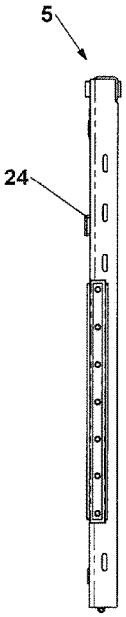
FIG. 6A is a front view of the left intermediate carriage assembly shown in FIG. 6.
Figure 6B:
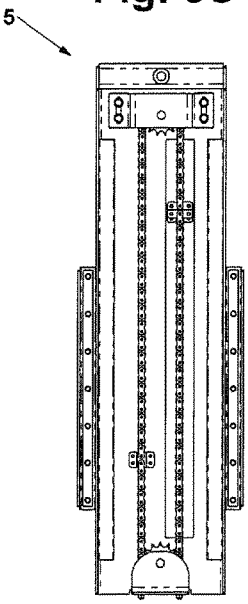
FIG. 6B is a right side view of the left intermediate carriage assembly shown in FIG. 6.
Figure 7:
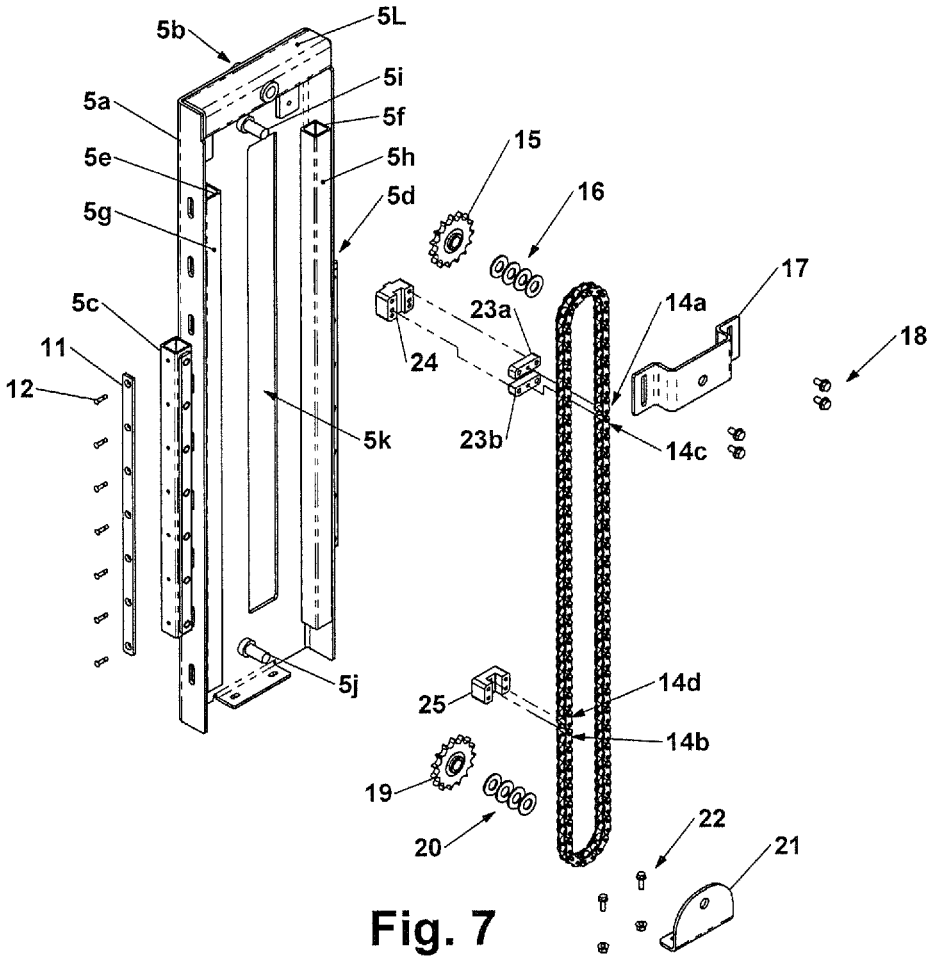
FIG. 7 is an exploded front upper left perspective view of the left intermediate carriage assembly also shown in FIGS. 1 through 4 and 6.
Figure 9:
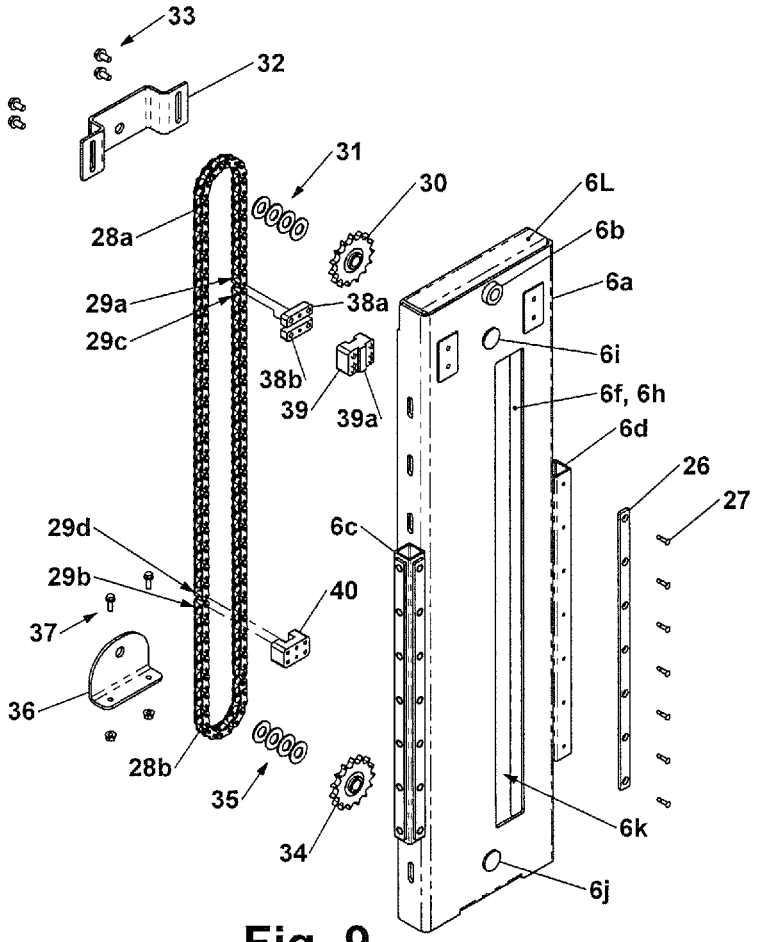
FIG. 9 is an exploded front upper left perspective view of the right intermediate carriage assembly also shown in FIGS. 1 through 4 and 8.

Generally, the first mechanism includes a lifting or lowering mechanism (collectively "vertical displacement mechanism") 3 which includes a movable platform assembly 4, a left intermediate carriage assembly 5, a right intermediate carriage assembly 6, a left lift cylinder 7, and a right lift cylinder 8. These cylinders may be pneumatic or hydraulic, but for consistency herein are collectively termed "hydraulic"). As illustrated in FIGS. 1 and 3, this vertical displacement mechanism 3 has a multi-, preferably two-stage mechanical apparatus that is capable of doubling the stroke of the hydraulic lift cylinders 6 and 7. This is accomplished by for example a set of roller chains or belts or other transmission means (collectively "chains", FIG. 6) that support the rising platform assembly 4 at each side. The chains travel around a set of sprockets or drivers (collectively, "sprockets") that are supported on each side by the intermediate carriage assemblies 5 and 6. Thus, a mechanical advantage is provided within the intermediate carriage assemblies 5 and 6 which move together at the same speed and through the same vertical distance provided by the lift cylinders 6 and 7. The roller chains and sprockets move together within the intermediate carriage assemblies 5 and 6, to preferably double the speed and travel range of motion of the rising platform assembly 4.

The travel speed and motion of the hydraulic lift cylinders 6 and 7 is preferably equalized by controlling both the pressure and flow of hydraulic fluid provided to the cylinders through various means and methods that include for example flow dividers, pressure compensators, electronic flow controls and valves and third cylinder circuit arrangements, and the like for example, which may be optionally included to operate the present disclosure within a complete prime mover and hydraulic or pneumatic system package (not shown).

The left intermediate carriage assembly 5 and right intermediate carriage assembly 6 each preferably include guide bearings (preferably of a glissile material like plastic) for vertical sliding engagement with vertical channel members incorporated within the main frame 2. Likewise, both the left and right sides of the rising platform assembly 4 also preferably include guide bearings for vertical sliding engagement with vertical interior guide members within the left intermediate carriage assembly 5 and right intermediate carriage assembly 6. This permits free vertical movement, mechanical alignment and guidance during relative motion of the assemblies during operation.

Figure 3A:
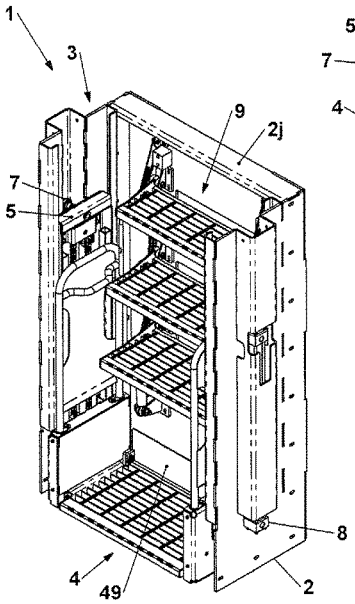
FIG. 3A a three-quarter front upper left perspective view of the access platform system shown in FIGS. 1 and 3 with the platform at the fully lowered position and with the folding steps deployed.

The doubling of the stroke or travel dimension of the lift cylinders 6 and 7 at the rising platform assembly 4 is advantageous. This multi-, preferably two-stage mechanical feature allows the rising platform assembly 4 to be initially set at a normal or otherwise parked and generally accessible position where the step member 46 is at an approximate height above the ground comparable to the heights of most permanently-mounted first steps for a given vehicle or mobile equipment application. Then, when a worker or machine operator ("person") approaches the access platform system 1 at ground level, this first mechanism, or vertical displacement mechanism 3, can be power-activated by a control switch to engage and automatically lower the step member 46 to become extended downwardly approximately 10 inches (25.4 cm) as shown in FIG. 3A for example, below that of the initial or normal and parked position.

With the rising platform assembly 4 now set to its lowest position, the person can then more easily and safely step up and onto the rising platform assembly 4 with relative ease and minimal risk of injury. Once standing upon the rising platform assembly 4, the person can then again activate a control switch to cause the access platform system 1 to raise the platform assembly 4 and himself as he remains positioned (i.e., standing or seated if non-ambulatory) upon it, to the desired maximum height and deck elevation level corresponding to the top-most portion of main frame 2. Once at the desired maximum height deck elevation, the person can then step off and exit the rising platform assembly 4 onto an adjacent stationary elevated deck or platform (not shown) associated with the equipment to which access is desired leading away from the rising platform assembly 4, again with relative ease and minimal risk as compared to what typical permanently fixed steps and stairways for example, are able to provide.

The reverse process of lowering the person from the height of the adjacent stationary elevated equipment, e.g., structure, deck or platform (not shown) back to ground level is accomplished in the approximate reverse sequence of the lifting or raising process with comparable ease and minimal hazard. Automated ease of ingress and egress involving large elevated vehicles or mobile equipment applications by workers or machine operators represents one benefit of the present disclosure.

Generally, the second mechanism includes a folding steps assembly 9 as shown in FIGS. 1 through 4, 14, 14A, and 15. This assembly 9 when folded-up to allows the lifting platform 4 to freely move upwardly and downwardly under power by activating a control switch to engage selected power and control. In the folded down or deployed position all the steps are secured in place. This mode of operation requires no external power to permit normal and traditional ingress and egress of persons involving large elevated vehicles or mobile equipment if power is turned off or as the result of a power outage, for example. This default mechanical configuration feature represents another advantage of the present disclosure.

Figure 3B:
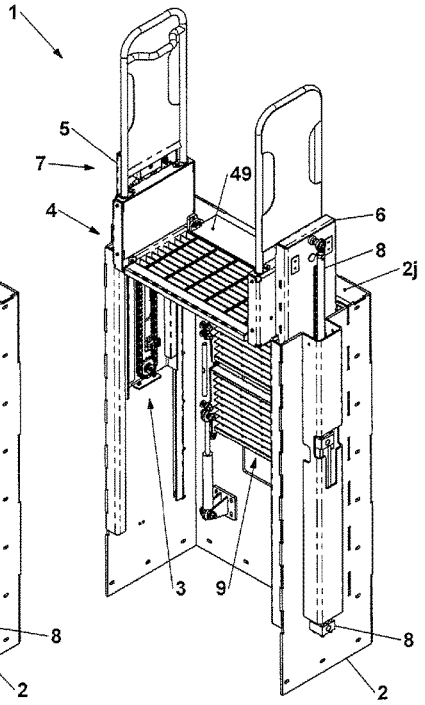
FIG. 3B a three-quarter front upper left perspective view of the access platform system shown in FIGS. 1 and 3 with the platform at the fully raised position and with the folding steps folded fully upward.
Figure 14:
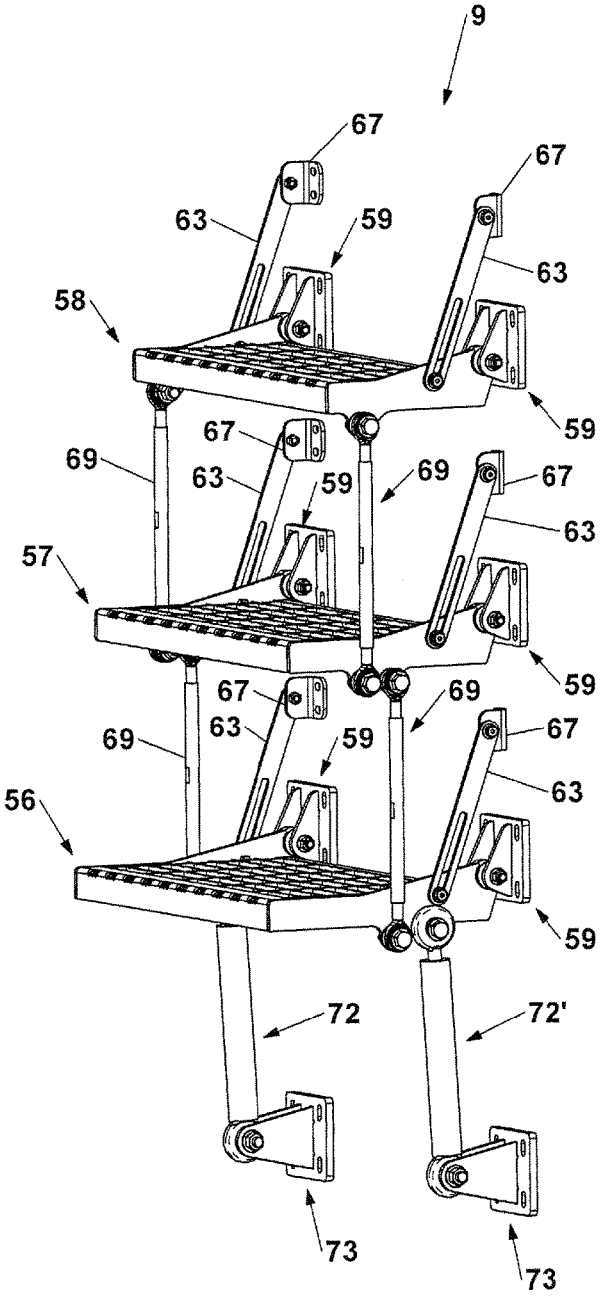
FIG. 14 is a front left upper perspective view of the folding steps assembly shown in FIGS. 1 through 4, with the steps deployed.
Figure 14A:
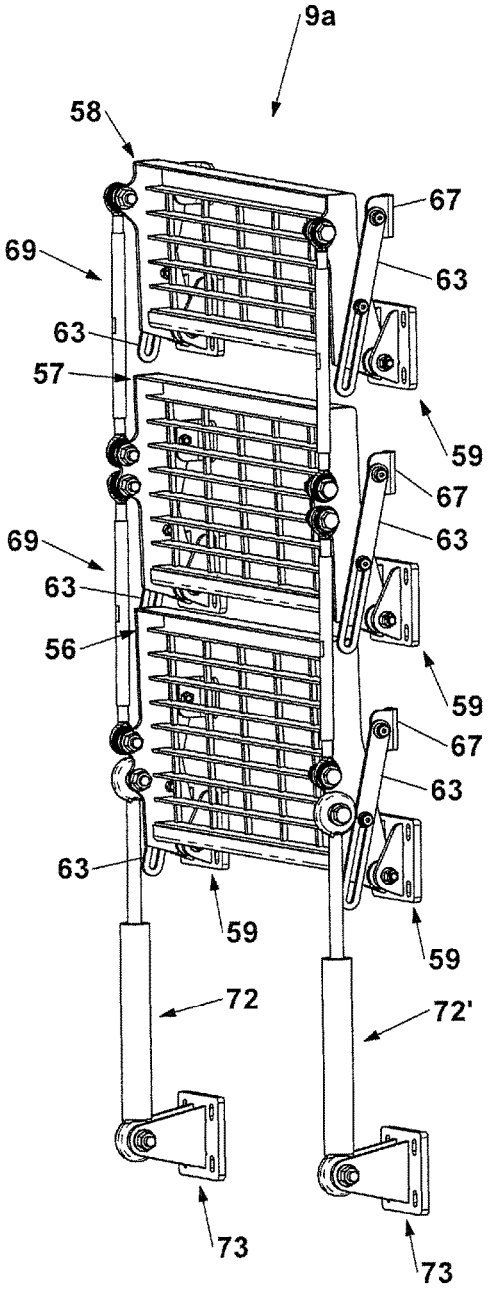
FIG. 14A is a front left upper perspective view of the folding steps assembly shown in FIGS. 1 through 4, with the steps folded.
Figure 15:
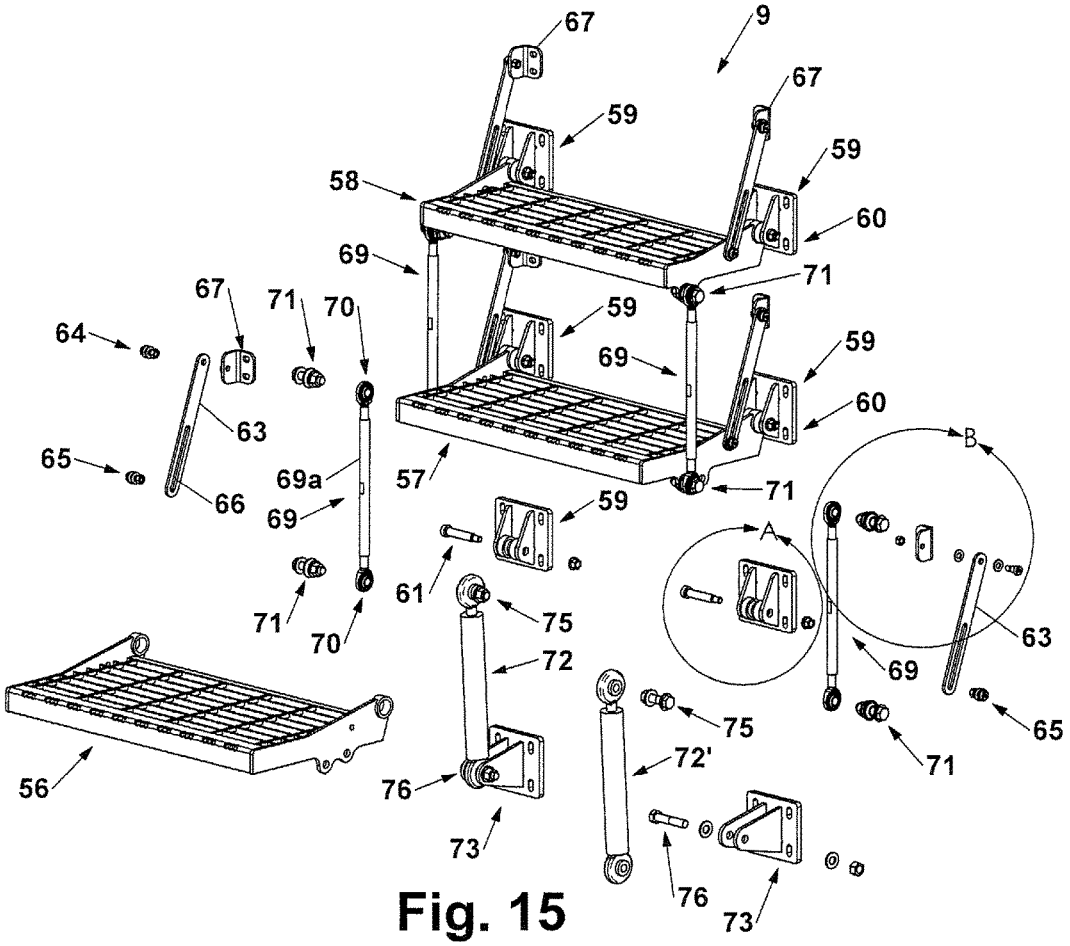
FIG. 15 is a partially exploded front left upper perspective view of the folding steps assembly shown in FIGS. 1 through 4 and 14, with the steps deployed.
Figure 15A:
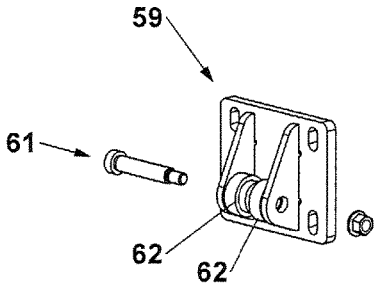
FIG. 15A is a detailed view of the folding steps assembly shown in FIG. 15.
Figure 15B:
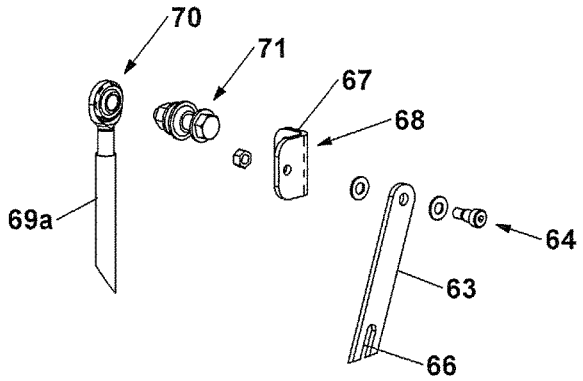
FIG. 15B is a detailed view of the folding steps assembly shown in FIG. 15.

Optionally as shown in FIGS. 3B and 14A, the folding steps assembly 9 may be stored in a folded-up configuration 9A and effectively locked-out from unauthorized personnel whenever large elevated vehicles or mobile equipment are shut-down or otherwise parked for periods of non-use. This mechanical configuration can provide an added level of security and equipment property protection by generally hindering access to equipment by unauthorized personnel and individuals should vehicles remain unattended at remote or unmonitored locations. Thus the ability to effectively fold-up and lock-out the folding steps assembly 9 from unauthorized use represents another aspect of the present disclosure.

For reference the overall general dimensions of one exemplary mechanized portion of the access platform system with integrated folding steps 1 is approximately 42 inches (1.07 m) wide by 18 inches (0.36 m) deep by (1.57 m) in height with the rising platform assembly 4 in the normal parked position. The general dimensions of the rising platform step member 46 are approximately 24 inches (0.61 m) wide by 14 inches (0.36 m) in depth. The rising platform assembly 4 including the step member 46 has a travel capability of approximately 60 inches (1.52 m) vertically. The overall size of the apparatus including the example dimensions may be changed by design or otherwise selected according to the particular requirements and foreseeable selected custom industrial application. Optionally and preferably, the disclosed apparatus may be custom-designed and manufactured for each specific application by customer specifications according to published industrial mobile equipment and/or vehicle ingress and egress standard safety guidelines for workers, vehicle operators and personnel. One goal is to meet any necessary safety requirements for safely reaching, stepping and standing upon the rising platform assembly 4, and optionally climbing or descending the folding steps mechanism 9, during normal use of the functional system package while meeting desired end-user of customer requirements.

Additionally a particular design application may further include optional, additional and various handrails, handles, hand holds, and safety guards which may be anticipated according to applicable safety standards. These however are not shown within the Figures as these added components are likely to vary significantly according to specific applications of the disclosure.

Figure 5:
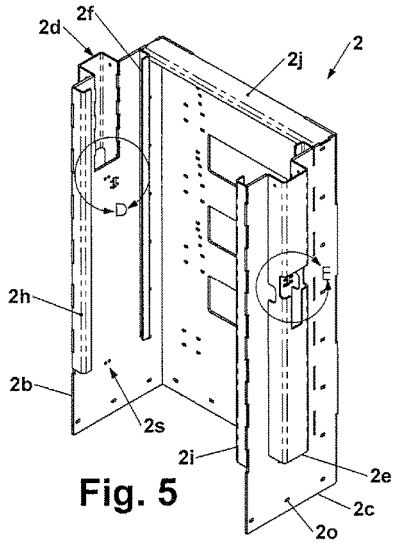
FIG. 5 is an front upper left perspective view of the main frame subassembly also shown in FIGS. 1 through 4.
Figure 5C:
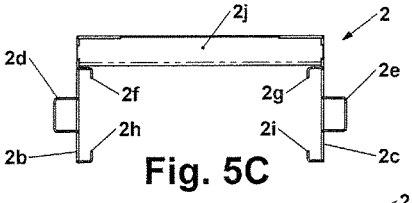
FIG. 5C is top view of the main frame subassembly shown in FIG. 5A.
Figure 5A:
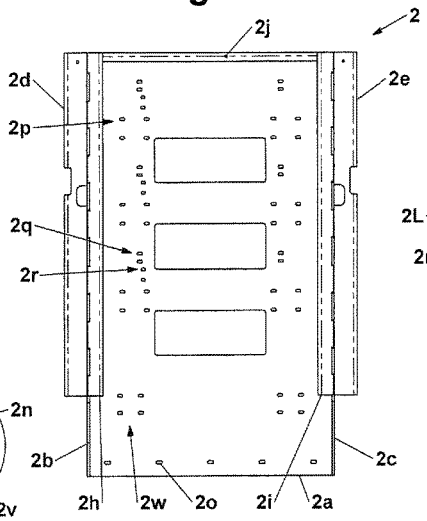
FIG. 5A is a front view of the main frame subassembly shown in FIG. 5.
Figure 5B:
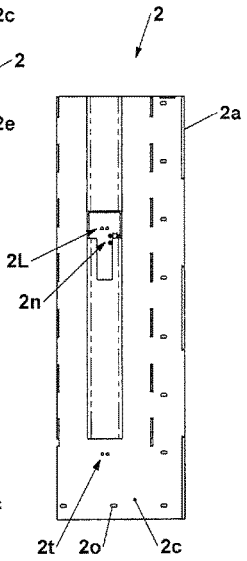
FIG. 5B is right side view of the main frame subassembly shown in FIG. 5A.
Figure 5D:
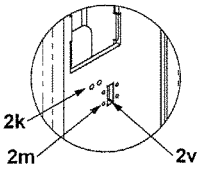
FIG. 5D is a first detail view of the main frame subassembly shown in FIG. 5.
Figure 5E:
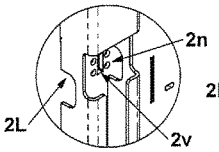
FIG. 5E is a second detail view of the main frame subassembly shown in FIG. 5.

FIGS. 5 through 5E show in an alternative embodiment further details and the construction of the main frame 2. Main frame 2 may be typically fabricated from mild sheet steel, aluminum, or other suitable structural materials. If weldable metals are used, the pieces may be, cut, fitted, and joined together by welding to form a single welded unit. Such pieces may include the main side support plate 2*c*, left side hydraulic lift cylinder enclosure 2*d*, right side hydraulic lift cylinder enclosure 2*e* and/or the top plate 2*j*. Lift cylinder enclosures 2*d* and 2*e* additionally provide added mechanical strength and stiffness to the respective sides 2*a* and 2*c* of main frame 2.

Along the side portions of main frame 2 a series of spaced vertical and horizontal structural mounting holes 2*o* can be provided if desired. These may be optionally included along the vertical sides 2*a* and 2*c* of main frame 2 to attach the entire assembly by some types of fasteners to another framework for example of a mobile equipment or vehicle chassis. Optionally, main frame 2 may be directly welded or otherwise secured in place as desired without the use of fasteners. It may be noted that top plate 2*j* of main frame 2 generally represents the maximum design height or elevation where the lifting platform 4 stops when reaching full height during lift modes of operation. The design height may be generally adjusted and selected according to a particular application, where the number of folding steps, as well as the vertical spacing of the steps may also be varied by design as a particular application, including the dimensional requirements for total height, are identified and met.

Additionally, internal vertical members of main frame 2 include left rear guide channel member 2*f*, right rear guide channel member 2*g*, left front guide channel member 2*h*, and right front guide channel member 2*i*. These internal members serve as guides or channels that provide vertical sliding freedom of movement, lateral support and guidance of left intermediate carriage assembly 5 and right intermediate carriage assembly 6 as they are moved up and down vertically within main frame 2 by the respective lift cylinders 7 and 8.

Figure 4:
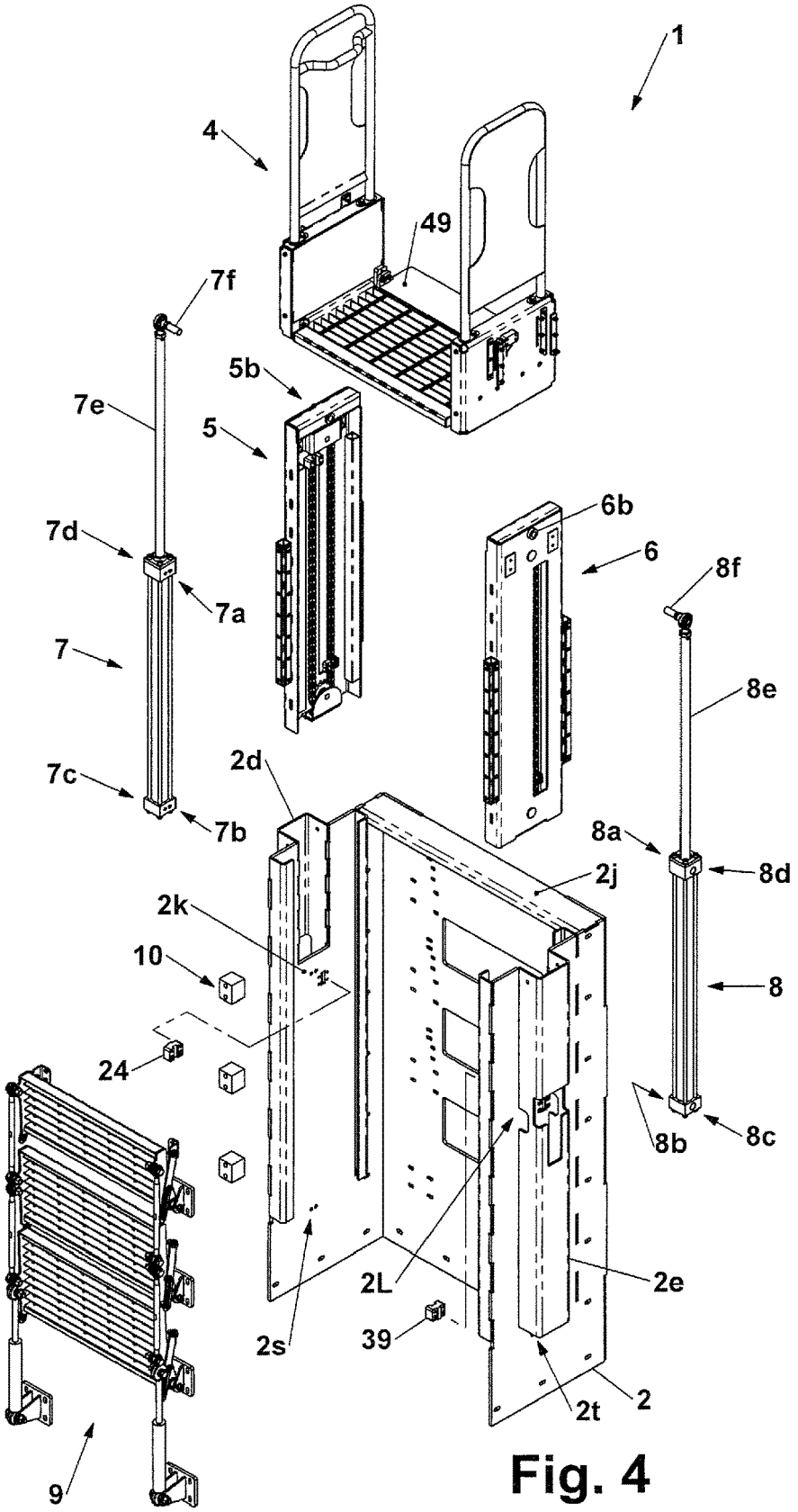
FIG. 4 is an exploded view of the access platform system shown in FIG. 3 illustrating the primary subassemblies of the present disclosure.

As shown in FIG. 4, vertical displacement mechanism 3 is powered for the lifting and lowering action of the lifting platform 4 by a pair of hydraulic or pneumatic cylinders or actuators. They include a left lift cylinder 7 and a right lift cylinder 8 which are securely attached by fasteners (not shown) to the main frame 2. Left hydraulic lift cylinder upper mounting holes 7*a* and right hydraulic cylinder mounting holes 8*a*, attach respectively to the main frame 2 at left hydraulic lift cylinder upper mounting holes 2*k*, and right hydraulic lift cylinder upper mounting holes 2*l*. Left lift cylinder lower mounting holes 7*b* and right cylinder lower mounting holes 8*b*, attach respectively to the main frame 2 at left lift cylinder lower mounting holes 2*s* and right lift cylinder lower mounting holes 2*t*. When secured in place the respective lift cylinders 7 and 8 are firmly attached at the respective sides of the main frame 2 and generally contained within the left and right side lift cylinder enclosures 2*d* and 2*e* respectively. Openings at the bottom and sides of cylinder enclosures 2*d* and 2*e* provide access for fluid fitting connections and lines (not shown) to the left and right lift cylinder extend hydraulic ports 7*c* and 8*c* respectively, and left lift cylinder retract hydraulic ports 7*d* and 8*d* respectively.

Further details of the two-stage platform vertical displacement mechanism 3 now follow. The two-stage vertical displacement mechanism 3 that vertically moves the rising platform assembly 4 preferably has a pair of intermediate carriage assemblies—a left intermediate carriage assembly 5 and a right intermediate carriage assembly 6. As shown in FIG. 4, the left hydraulic lift cylinder rod end attachment 7*f* of left hydraulic lift cylinder rod 7*e* is attached to left intermediate carriage 5 at left hydraulic lift cylinder upper mounting tube 5*b*. Likewise, the right hydraulic lift cylinder rod end attachment 8*f* of right hydraulic lift cylinder rod 8*e* is attached to right intermediate carriage 6 at right hydraulic lift cylinder upper mounting tube 6*b*.

As shown in greater detail in FIGS. 6, 6A, 6B, 6C, 6D, 6E and 7, the left intermediate carriage 5 preferably has a structural frame 5*a* which may be may be typically fabricated from cut, machined, bent, or formed mild steel, aluminum or other suitable materials and common shape structural members, fitted and welded together into a single welded unit for example. A left side hydraulic lift cylinder upper mounting tube 5*b* generally in shape of a round tube extends through square tube support member 5L and is welded into place for load bearing strength. A front exterior guide member 5*c* and a rear exterior guide member 5*d* are fastened, e.g. by welding into place at the front and rear faces of structural frame 5*a*. Front interior guide member 5*e* and rear interior guide member 5*h* include a square structural tube that is welded into place at the interior front and rear surfaces respectively of structural frame 5*a*. Upper sprocket shaft 5*i* and lower sprocket shaft 5*j* each extend through the wall of structural frame 5*a* and are welded into place for load bearing strength. A main frame left chains anchor block elongated clearance opening 5*k* provides a clearance path for the main frame left chains anchor block 24 as it extends through this opening and is attached to the main frame 2. Additionally, as the left intermediate carriage 5 is raised and lowered within main frame 2, it slides at (in one embodiment) six exterior guide bearings 11, which are preferably comprised of plastic (or other optional suitable surface contact bearing materials), and are attached to intermediate carriage 5 by a series of exterior guide bearing fasteners 12. The six exterior guide bearings 11 (three at the front and three at the rear) slidably engage within the vertical channels effectively provided at main frame 2 by left rear guide channel member 2*f* and left front guide channel member 2*h*. Likewise, the three exposed sides of front interior guide member 5*e*, and the three exposed sides of rear interior guide member 5*f* comprise front interior guide member sliding surfaces 5*g*, and rear interior guide member sliding surfaces 5*h* respectively, for vertical sliding engagement of left intermediate carriage 5 within the main frame 2.

Top roller chain 13*a* of the left intermediate carriage 5 engages upper sprocket 15 for free rotation at upper sprocket shaft 5*i*, and is held into place by sprocket spacer washers 16, upper sprocket retainer plate 17, and retainer plate fasteners 18. Bottom roller chain 13*b* of the left intermediate carriage 5 engages lower sprocket 19 for rotation at lower sprocket shaft 5*j*, and is held into rotatable position by sprocket spacer washers 20, lower sprocket retainer plate 2*l*, and retainer plate fasteners 2*l*. The top roller chain 13*a* and bottom roller chain 13*b* are each connected to left roller chains rising platform anchor block 25 by master links 14*d* and 14*b*. Likewise, the opposite ends of top roller chain 13*a* and bottom roller chain 13*b* are each connected to left top roller chain frame anchor block 23*a*, and left bottom roller chain frame anchor block 23*b* by roller chain master links 14*a* and 14*c*. These two small anchor blocks (23*a* and 23*b*) are then fastened by four threaded cap screws (not shown) to larger left roller chains main frame anchor block 24, which is further fastened by four additional threaded cap screws (not shown) at left roller chains anchor block mounting holes 2*m* (shown in detail in FIG. 5*d*) of main frame 2.

A rectangular protrusion 24*a* is provided at left roller chains main frame anchor block 24 for the purpose of further engaging and securing main frame left roller chains anchor block 24 within rectangular opening 2*u* (shown in detail in FIG. 5D) of main frame 2. The purpose of this is to provide additional strength, reliability, and self-location of the anchor block 24 at main frame 2, such that a transfer of the expected vertical shear force loads from the roller chains 13*a* and 13*b* into the main frame 2 need not entirely rely upon the strength of the four left anchor block fasteners (not shown). Thus the rectangular protrusion 24*a* at left roller chains main frame anchor block 24 engaged with main frame left roller chains anchor block rectangular opening 2*u* provides an effective and more robust and positive keyed mechanical connection.

The multi, preferably two-stage mechanical apparatus that provides the doubling of the stroke dimension of the hydraulic lift cylinders 6 and 7 at the rising platform assembly 4, is provided for example, when left intermediate carriage 5 is raised a given distance by the left hydraulic lift cylinder 7. In this instance the chains and sprockets also advance upward by the same distance along with the left intermediate carriage 5. However, because each end of the left roller chains 13*a* and 13*b* are fixed at one end to the main frame 2, by chain anchor blocks 23*a*, 23*b*, and 24, the left roller chains rising platform anchor block 25 is caused to advance upward at twice the speed and distance as that of the vertical movement of left intermediate carriage 5. Concurrently, since the left roller chains rising platform anchor block 25 are also fastened (by threaded cap screws for example; not shown) to the rising platform assembly 4, the rising platform assembly 4 also advances upward at twice the speed and distance as that of the left intermediate carriage 5. Thus, the two-stage advantage of the vertical displacement mechanism 3 at the left side of the apparatus is provided.

During retraction and lowering of left lift cylinder 7, including the left intermediate carriage 5, the same and opposite mechanical effect occurs at the chains, sprockets, and chain anchor blocks when the left intermediate carriage 5 descends, and therefore causes the rising platform assembly 4 to be lowered at twice the speed and distance as that provided by left lift cylinder 7.

As shown in greater detail in FIGS. 8, 8A, 8B, 8C, 8D and 9, the right intermediate carriage 6 preferably has a structural frame 6*a* which may be typically fabricated from cut, machined, bent, or formed mild steel, aluminum or other suitable materials and common shape structural members, which are fitted and welded together into a single welded unit for example. A right side hydraulic lift cylinder upper mounting tube 6*b* generally in the shape of a round tube extends through square tube support member 6L and is welded into place for load bearing strength. A front exterior guide member 6*c* and a rear exterior guide member 6*d* are welded into place at the front and rear faces of structural frame 6*a*. Front interior guide member 6*e* (hidden from view) and rear interior guide member 6*h* (partially hidden from view) are comprised of square structural tube and welded into place at the interior front and rear surfaces respectively of structural frame 6*a*. Upper sprocket shaft 6*i* and lower sprocket shaft 6*j* each extend through the wall of structural frame 6*a* and are welded into place for load bearing strength. A main frame right chains anchor block elongated clearance opening 6*k* provides a clearance path for the main frame right chains anchor block 39 as it extends through this opening and is attached to the main frame 2. Additionally, as the right intermediate carriage 6 is raised and lowered within main frame 2, it slides at, for example, six exterior guide bearings 26, which are preferably comprised of plastic (or other optional suitable surface contact bearing materials), and are attached to intermediate carriage 6 by a series of exterior guide bearing fasteners 27. The six exterior guide bearings 26 (three at the front and three at the rear) slidably engage within the vertical channels effectively provided at main frame 2 by right rear guide channel member 2*g* and right front guide channel member 2*i*. Likewise, the three exposed sides of front interior guide member 6*e* (hidden from view), and the three exposed sides of rear interior guide member 6*f* (partially hidden from view) comprise front interior guide member sliding surfaces 6*g* (hidden from view), and rear interior guide member sliding surfaces 6*h* (partially hidden from view) respectively, for vertical sliding engagement of right intermediate carriage 6 within the main frame 2.

Top roller chain 28*a* of the right intermediate carriage 6 engages upper sprocket 30 for free rotation at upper sprocket shaft 6*i*, and is held into place by sprocket spacer washers 31, upper sprocket retainer plate 32, and retainer plate fasteners 33. Bottom roller chain 28*b* of the right intermediate carriage 6 engages lower sprocket 34 for rotation at lower sprocket shaft 6*j*, and is held into rotatable position by sprocket spacer washers 31, lower sprocket retainer plate 36, and retainer plate fasteners 37. The top roller chain 28*a* and bottom roller chain 28*b* are each connected to right roller chains rising platform anchor block 40 by master links 29*d* and 29*b*. Likewise, the opposite ends of top roller chain 28*a* and bottom roller chain 28*b* are each connected to right top roller chain frame anchor block 38*a*, and right bottom roller chain frame anchor block 38*b* by roller chain master links 29*a* and 29*c*. These two small anchor blocks (29*a* and 29*b*) are then fastened by four threaded cap screws (not shown) to larger right roller chains main frame anchor block 39, which is further fastened by four additional threaded cap screws (not shown) at right roller chains anchor block mounting holes 2*n* (shown in detail in FIG. 5E) of main frame 2.

A rectangular protrusion 39*a* is provided at right roller chains main frame anchor block 39 for the purpose of further engaging and securing main frame right roller chains anchor block 39 within rectangular opening 2*v* (shown in detail in FIG. 5E) of main frame 2. The purpose of this is to provide additional strength, reliability, and self-location of the anchor block 39 at main frame 2, such that a transfer of the expected vertical shear force loads from the roller chains 28*a* and 28*b* into the main frame 2 need not entirely rely upon the strength of the four anchor block fasteners (not shown). Thus the rectangular protrusion 39*a* at left roller chains main frame anchor block 39 engaged with main frame right roller chains anchor block rectangular opening 2*v* provides an effective and more robust and positive keyed mechanical connection.

The two-stage mechanical apparatus that provides the doubling of the stroke dimension of the hydraulic lift cylinders 6 and 7 at the rising platform assembly 4, is provided for example, when right intermediate carriage 6 is raised a given distance by the right hydraulic lift cylinder 8. In this instance the chains and sprockets also advance upward by the same distance along with the right intermediate carriage 6. However, because each end of the right roller chains 28*a* and 28*b* are fixed at one end to the main frame 2, by chain anchor blocks 38*a*, 38*b*, and 39; the right roller chains rising platform anchor block 40 is caused to advance upward at twice the speed and distance as that of the vertical movement of right intermediate carriage 6. Concurrently, since the right roller chains rising platform anchor block 40 is also fastened (by threaded cap screws for example; not shown) to the rising platform assembly 4, the rising platform assembly 4 also advances upward at twice the speed and distance as that of the right intermediate carriage 6. Thus, the two-stage mechanical advantage of the vertical displacement mechanism 3 at the right side of the apparatus is provided.

During retraction and lowering of right lift cylinder 8, including the right intermediate carriage 6, the same and opposite mechanical effect occurs at the chains, sprockets, and chain anchor blocks when the right intermediate carriage 6 descends, and therefore causes the rising platform assembly 4 to be lowered at twice the speed and distance as that provided by right lift cylinder 8.

Accordingly as described above, both the right and left lift cylinders 7 and 8, including the right and left intermediate carnages 5 and 6 all respectively, all work together to simultaneously raise and lower the rising platform assembly 4.

Figure 10:
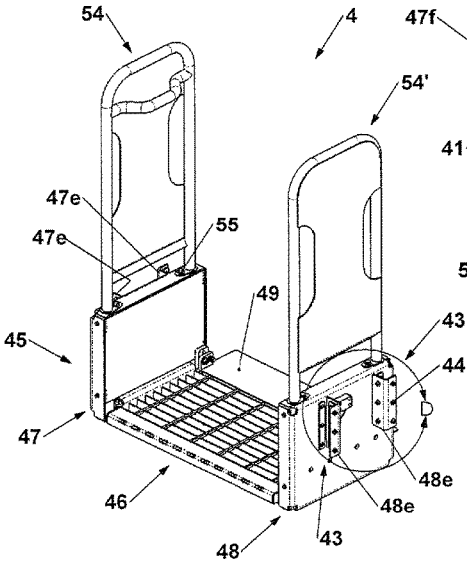
FIG. 10 is a front upper left perspective view of the vertical displacement mechanism also shown in FIGS. 1 through 4.
Figure 10C:
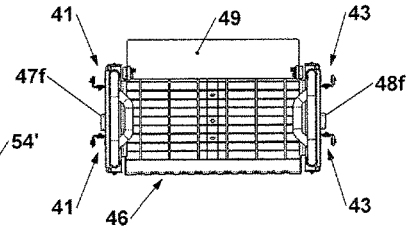
FIG. 10C is a top view thereof.
Figures 11, 11A, 11B:
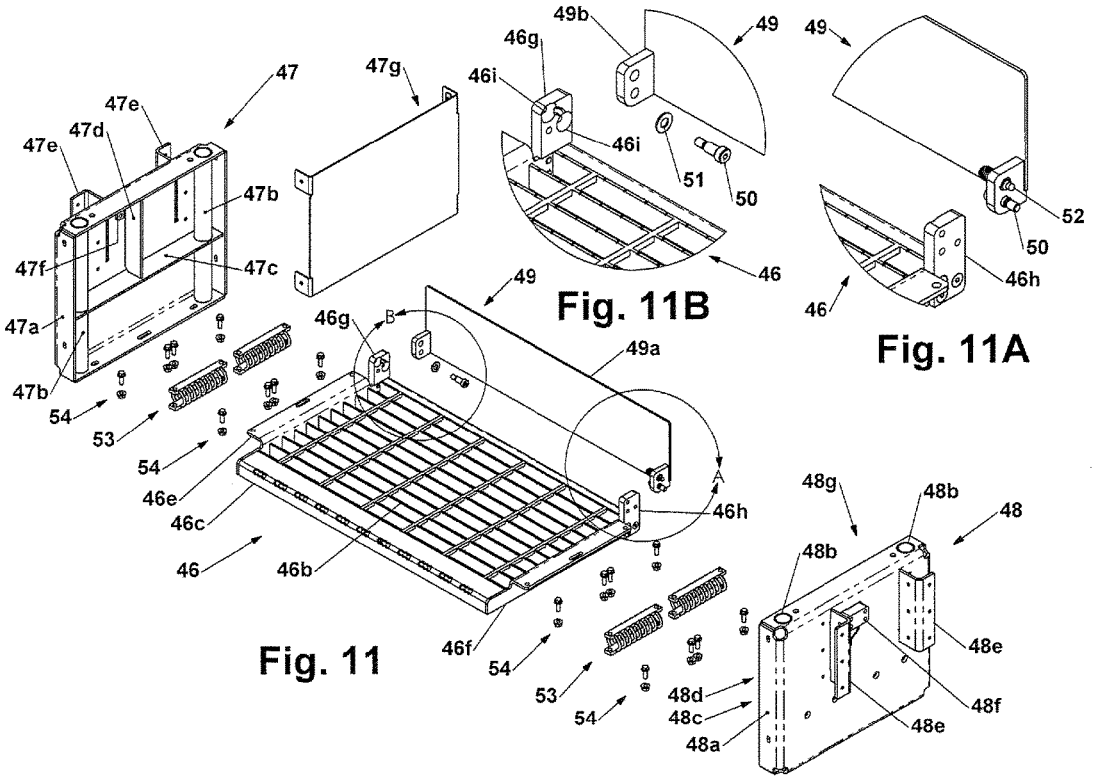
FIG. 11 is an exploded front upper left perspective view thereof.
FIG. 11A is a first detail view of the exploded front upper left perspective view of the vertical displacement mechanism shown in FIG. 11.
FIG. 11B is a second detail view thereof.

FIGS. 10 through 11A show details of the rising platform assembly 4 including lower subassembly 45 comprised of left sliding support assembly 47 and right sliding support assembly 48.

As shown in FIG. 11, the primary members of the left sliding support assembly 47 and right sliding support assembly 48 are left sliding support main structural member 47*a*, and right sliding support main structural member 48*a*, which may be typically fabricated from cut, machined, bent, or formed mild steel, aluminum or other suitable materials and common shape structural members, which is fitted and welded together into a single welded unit for example.

Left sliding support main structural member 47*a*, and right sliding support main structural member 48*a*, each may include handrail mounting tubes 47*b* and 48*b*, horizontal support plates 47*c* and 48*c* (48*c* not visible), vertical support plates 47*d* and 48*d* (48*d* not visible), linear bearing mounting angles 47*e* and 48*e*, and finally rising platform left side chains anchor block mount 47*f*, and rising platform right side chains anchor block mount 48*f*.

Rising platform left and right side sliding support structural member covers 47*g* and 48*g* (48*g* not shown) are fastened by threaded hardware onto left sliding support main structural member 47*a*, and right sliding support main structural member 48*a*.

Figure 10D:
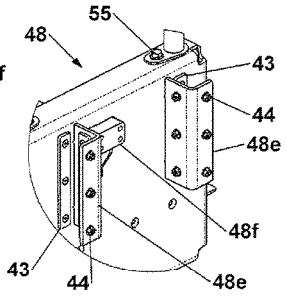
FIG. 10D is a detailed view thereof.
Figure 10A:
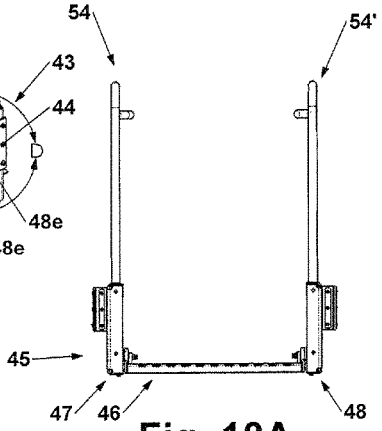
FIG. 10A is a front view thereof.
Figure 10B:
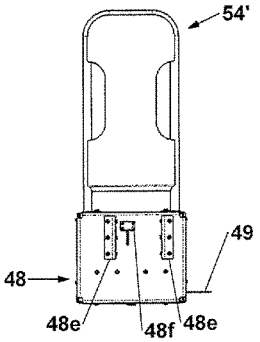
FIG. 10B is right side view thereof.

As shown in FIGS. 10 through 10D, left sliding support assembly 47 and right sliding support assembly 48 includes three left and three right side rising platform guide bearings 41 and 43. These are attached to the interior faces of left sliding support linear bearing mounting angles 47*e* and right sliding support linear bearing mounting angles 48*e* respectively, by a series of left side guide bearing fasteners 42, and a series of right side guide bearing fasteners 44. The left and right rising platform guide bearings, which are preferably comprised of plastic (or other optional suitable surface contact bearing materials), respectively and slidably engage with the left intermediate carriage front interior guide member 5*e*, left intermediate carriage rear interior guide member 5*f*, right intermediate carriage front interior guide member 6*e*, and right intermediate carriage rear interior guide member 6*f*; at the respective intermediate carriages front interior guide member sliding surfaces 5*g*, 5*h*, 6*g*, and 6*h* shown in FIGS. 6 through 9.

Thus, the engaged members serve as guides or channels providing vertical sliding freedom of movement, lateral support and guidance of the left sliding support assembly 47 and the right sliding support assembly 48 of the rising platform lower subassembly 45, which further includes the rising platform assembly 4, relative to both the left and right intermediate carriage assemblies 5 and 6 previously described.

As shown in FIG. 11, the central portion of the rising platform lower subassembly 45 is further comprised of rising platform step member 46. Rising platform step member 46 may be typically fabricated from cut, machined, bent, or formed mild steel, aluminum or other suitable materials and common shape structural members, which is fitted and welded together into a single welded unit for example.

Rising platform step member 46 is comprised of step member grating 46*b* which in the present embodiment provides a high traction surface and debris shedding capabilities; however other step member materials may be optionally selected by design. The remaining components of step member 46 includes step member front support 46*c*, step member rear support 46*d*, left edge plate 46*e*, right edge plate 46*f*, left vertical plate 46*g*, and right vertical plate 46*h*.

Rising platform step member 46 is attached to and supported by four flexible support members 53 (two at each side) extending between respective left edge plate 46*e* and right edge plate 46*f* and the respective lower edge surfaces of left sliding support assembly 47 and the right sliding support assembly 48 by a series of threaded fasteners 54 at each side.

One purpose of this design feature is to provide an increased level of flexibility and mechanical deflection forgiveness between these assemblies to help ease dimensional specifications and help ensure that the design works well in harsh outdoor environments for example. This increased flexibility further provides improved resistance of the apparatus to a certain amount of potential impact damage or mechanical deflection in a rugged mobile equipment environment for example, while still allowing the rising platform system to operate properly, thus maximizing the serviceability of the entire device. For example, if either of the vertical side walls of the main frame 2 or the rising platform assembly 4 sustained damage resulting in the vertical sliding members of these assemblies to become misaligned or otherwise non-parallel, the rising platform assembly 4 would remain much more likely to continue operating properly. Without the additional design flexibility provided by flexible support members 53, binding would be more likely to occur with as little as 0.13 inches (3.3 mm) of misalignment between the primary sliding assemblies. Therefore incorporation of the flexible support members 53 between the rising platform step member 46, left sliding support assembly 47, and the right sliding support assembly 48 provides another advantage of the present disclosure.

Rising platform step member 46 further includes pivotable deck plate assembly 49 at the rear portion of rising platform assembly 4. The purpose of pivotable deck plate assembly 49 is to both provide a vertical kick plate for workers of machine operators while standing and riding on the rising platform assembly 4, and to bridge the gap that would otherwise exist in the walkway surface between the main frame top plate 2*j* of main frame 2 and the of step member grating 46*b* of the rising platform assembly 4 when at the fully raised position. Pivotable deck plate assembly 49 would be manually flipped or folded down to bridge across the gap.

Pivotable deck plate assembly 49 includes a deck plate traction surface member 49*a*, left end plate 49*b*, right end plate 49*c*, two pivot fasteners 50, two pivot fastener washers 51, and at least one pivotable deck plate positional detent lock mechanism 52. When pivotable deck plate assembly 49 is at either of the flipped up vertical or flipped down horizontal position, positional detent lock mechanism 52 engages with pivotable deck plate detent reliefs 46*i* provided at either of step member left vertical plates 46*g* or 46*h* to help secure the pivotable deck plate assembly 49 at either of the vertical or horizontal positions as required.

The pivotable deck plate assembly 49 is designed to remain in the flipped up vertical position whenever the rising platform assembly 4 is in the process of being either raised or lowered. This is necessary to avoid any expected mechanical contact and interference with the components of the folding steps mechanism 9, particularly when set to the folded up configuration 9*a* during raising and lowering operation of the rising platform assembly 4.

Additionally, when the pivotable deck plate assembly 49 is in the flipped down horizontal position while the rising platform assembly 4 is at the fully raised position, pivotable deck plate assembly 49 is designed to automatically become set to the flipped up vertical position by its expected contact engagement with the main frame top plate 2*j* of main frame 2, and therefore becomes automatically pushed up into the correct position, when the rising platform assembly 4 begins moving in a downward direction during a descent or lowering operation.

Optionally, the pivotable deck plate assembly 49 may be designed to be automatically moved as required by series of additionally designed mechanical linkages engaged with and powered by the vertical movements of the rising platform assembly 4.

Further optionally, the pivotable deck plate assembly 49 may be designed to be actively and automatically moved as required by a powered actuator, such as for example; by at least one small hydraulic or pneumatic air cylinder, an electric motor or linear actuator, an electromechanical solenoid, an electromagnet, or any other foreseeable types of actuating devices. Therefore, incorporation of automatic actuation of the pivotable deck plate assembly 49 represents another advantage of the present disclosure.

Figure 12:
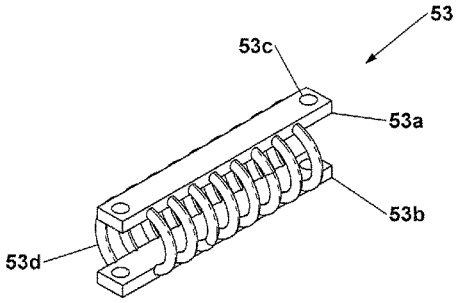
FIG. 12 is a front upper left perspective view of a flexible support member shown in FIG. 11.
Figure 12C:
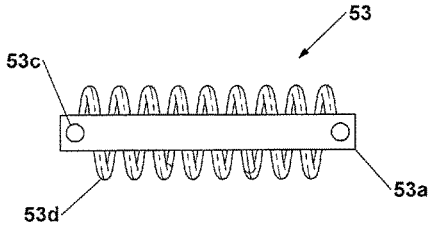
FIG. 12C is a top view of a flexible support member shown in FIGS. 11 and 12.
Figure 12A:
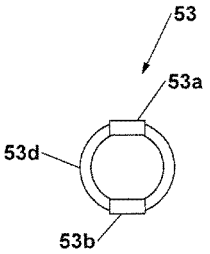
FIG. 12A is a front view of a flexible support member shown in FIGS. 11 and 12.
Figure 12B:
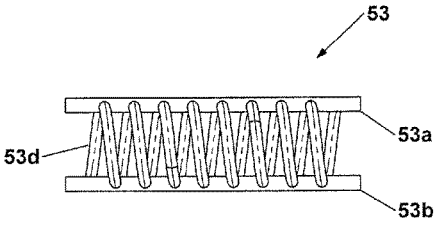
FIG. 12B is a right side view of a flexible support member shown in FIGS. 11 and 12.

As shown in FIGS. 11 through 12C, the flexible support members 53 of the lower subassembly 45 of rising platform assembly 4, may include wire-rope vibration-damping mounts. The flexible support members 53 as described previously, are flexible members typically comprised of a flexible supporting element 53*d* made up of a coil of stainless steel wire cable that is wound into or otherwise clamped into upper and lower mounting plates 53*a* and 53*b*. The upper and lower mounting plates 53*a* and 53*b* may be comprised of at least two to four aluminum bars which may be optionally chromate coated for additional corrosion resistance. A series of mounting holes 53*c* are provided at upper and lower mounting plates 53*a* and 53*b* for attachment to the lower subassembly 45 of rising platform assembly 4. Therefore, and as stated previously, incorporation of the flexible support members 53 between the rising platform step member 46, left sliding support assembly 47, and the right sliding support assembly 48 represents another advantage of the present disclosure.

As shown in FIGS. 10 through 10D, and in detail in FIGS. 13 through 13C, a pair of rising platform left and right handrail assemblies 54 and 54' may be attached to the lower subassembly 45 of rising platform assembly 4. Handrail assembly 54 may be typically fabricated from cut, machined, bent, or formed mild steel, aluminum or other suitable materials and common shape structural members, which is fitted and welded together into a single welded unit for example. Handrail assembly 54 is comprised of handrail main tube member 54*a*, cross support tube 54*b*, inboard handle 54*c*, guard plate 54*d*, and handrail attachment plates 54*e*. Attachment of the left and right handrail assemblies 54 and 54' is accomplished by concentric engagement of the lower portions of handrail main tube member 54*a* within the respective handrail mounting tubes 47*b* and 48*b* of their respective left sliding support assembly 47 and right sliding support assembly 48. The left and right handrail assemblies 54 and 54' are secured at handrail attachment fasteners 55 at fastener mounting holes 54*f*. The concentric engagement and overlap of the lower portions of handrail main tube member 54*a* within the respective handrail mounting tubes 47*b* and 48*b* of their respective left sliding support assembly 47 and right sliding support assembly 48 provides excellent mechanical support and resistance to deflection from lateral loads that are expected and likely to occur at the top portions of left and right handrail assemblies 54 and 54' while in use by persons such as workers, vehicle operators and personnel.

The combination of concentric engagement and overlap of the lower portions of handrail main tube member 54*a* within the respective handrail mounting tubes 47*b* and 48*b*, as well as the ability to easily disassemble and re-assemble the left and right handrail assemblies 54 and 54' at the rising platform assembly 4 for ease of replacement as needed for example due to damage from impacts, represents another advantage of the present disclosure.

As shown in FIGS. 1 through 4 and FIGS. 14, 14A, 15, 15A, and 15B, the folding steps mechanism 9 utilizes in one embodiment two hydraulic cylinders or actuators 72 and 72' to control the movement and orientation of the three access step members located just above the rising platform step member 46 of lifting platform 4. Hydraulic cylinders or actuators 72 and 72' are attached to back support plate 2*a* of main frame 2 at folding steps cylinder support bracket mounting holes 2*w*, by eight hydraulic cylinder mounting bracket mounting fasteners 74 (not shown).

Generally, it should be understood that the travel speed and motion of the two hydraulic cylinders or actuators 72 and 72' is ideally the same by controlling both the pressure and flow of hydraulic fluid provided to the cylinders through various means and methods known to the fluid power industry. Various means and methods may include for example flow dividers, pressure compensators, electronic flow controls and valves and third cylinder circuit arrangements, and the like for example, which may be optionally included to operate the present disclosure within a complete prime mover and hydraulic system package (not shown).

As generally described above, it may be optional to provide only one hydraulic cylinder or actuator 72 for example, to actuate the folding steps mechanism 9. Other foreseeable types of mechanical actuators may also be optionally used while remaining within the scope of the present disclosure.

In one alternate embodiment, three step members (folding bottom step member 56, middle step member 57, top step member 58), are mechanically linked in a fashion comparable to a series of at least two 4-bar mechanical linkages to ensure they all move together in a controlled way. The folding steps mechanism 9 is designed to provide a conventional fixed set of steps or a stairway when moved and set to the folded-down or deployed position. Alternately, the folding steps mechanism 9 is also able to be moved and set to become folded up to a retracted and out of the way position whenever the lifting platform 4 is being either raised or lowered. This mode of operation or folded up configuration 9*a* is most clearly shown in FIG. 14A.

As shown in detail in FIGS. 14, 14A, 15, 15A, and 15B, the folding steps mechanism 9 includes two hydraulic cylinders or actuators 72 and 72' to control the movement and orientation of three access steps located just above the rising platform step member 46 of lifting platform 4. In this embodiment, three step members (folding bottom step member 56, middle step member 57, top step member 58), are mechanically linked in a fashion comparable to a series of at least two 4-bar mechanical linkages by four folding steps support linkages 69.

The three folding step members 56, 57, and 58 may be typically fabricated from cut, machined, bent, or formed mild steel, aluminum or other suitable materials and common shape structural members, which is fitted and welded together into a single welded unit for example. Each central portion of the folding step members is preferably comprised of step member grating (the same material as used at rising platform step member 46) in which in the present embodiment provides a high traction surface and debris shedding capabilities; however other step member materials may be optionally selected by design.

It may be further noted that the dimensional width of each of the folding step members 56, 57, and 58 is approximately the same, however the depth dimensions may optionally and preferably successively decrease such that the outer-most portion of each step is set at a dimension at least slightly further back from the outer-most portion of its preceding step member located just below. This feature selected by design, offers the benefit of improved ergonomics for workers, vehicle operators and personnel using the steps in the folded down position and represents another key aspect and benefit advantage of the present disclosure in combination with the other key and novel functional aspects of the present disclosure.

Folding bottom step member 56, middle step member 57, top step member 58, are each pivotally attached to six respective folding steps support brackets 59, at respective folding steps support bracket elastomeric isolators 62, by a series of six respective concentric pivot fastener bushings 62*a* (not shown) and a series of six respective threaded pivot fasteners with threaded nuts 61. Each of the six respective folding steps support brackets 59 are attached to the interior of back support plate 2*a* of main frame 2, at folding steps support brackets mounting holes 2*p* (shown in FIG. 5A), by 24 mounting fasteners 60 (not shown).

A series of respective folding steps limiting straps 63 are provided for engagement with each of the folding step members 56, 57, and 58 for the purpose of positively supporting and limiting the downward movement of each of the step members when set to the folded down or deployed position. A series of six limiting strap upper pivot fasteners 64, six limiting strap support brackets 67, and twelve limiting strap support bracket fasteners 68 (not shown) are attached to the interior back support plate 2*a* of main frame 2, at limiting strap support brackets mounting holes 2*q* (shown in FIG. 5A). A series of six folding steps limiting strap lower pivot fasteners 65, fasten and engage six respective limiting strap guide slots 66, at holes at each side of the respective folding step members 56, 57, and 58, thus allowing free upward movement of the steps when they are being pivoted to the folded configuration.

Four folding steps support linkages 69 are each further comprised of respective structural tube members 69*a* further including threaded connections at each end, threaded spherical rod ends 70 at each end, and respective spherical rod end threaded fasteners 71 which pivotally attach each of the respective four support linkages 69 to their respective folding step members 56, 57, and 58.

Therefore, the folding steps mechanism 9 of the access platform system with integrated folding steps mechanism 1 provides an the efficient and compact arrangement and use of space since the lifting platform 4 passes through the same relative volume of space as occupied by the folding steps mechanism 9 when the folding steps assembly 9 is at the folded down or deployed position. Additionally, the folding steps mechanism 9 may be actuated to freely move upward and downward under power by means of a control switch for example to engage selected power and control of the mechanism. Optionally, the upward and downward movement of the folding steps mechanism 9 may be automatically controlled in desired coordination by a programmed electronic controller, including position limit switches, proximity switches, and other similar sensor input means in combination with the control and movement of the rising platform assembly 4 as it is either raised or lowered during automated operation. This automated sensing and control aspect and feature represents another advantage of the present disclosure.

Therefore the disclosed apparatus provides a folding steps assembly 9 that when folded-up to allows the lifting platform 4 to freely move upward and downward under power by means of at least one control switch to engage and select power and control of the apparatus. This mode of operation provides the benefits and advantages of power-assisted lifting and lowering ingress and egress of workers or machine operators involving large elevated vehicles or mobile equipment. Alternatively, while in the folding steps assembly 9 is in the folded down or deployed position, all the folding steps are secured into place as a typical stairway or ladder. This mode of operation may represent a default mechanical configuration of the current disclosure requiring no power to permit normal and traditional ingress and egress of workers or machine operators involving large elevated vehicles or mobile equipment in the event that equipment is turned off or as the result of a power outage, for example. This overall combination of automated and default mechanical configurations and design features offer several advantages, as discussed earlier.

Changes and modifications in the specifically described embodiments may be carried out without departing from the principles of the present disclosure, which is intended to be limited only by the scope of the appended claims.

What is claimed is:

1. An access platform system for enabling access to and egress from ground-based structures, vehicles, and mobile equipment, the system having:

a main frame that is attached to or juxtaposed with the ground-based structures, vehicles, or mobile equipment;

a vertical displacement mechanism attached to the main frame, the vertical displacement mechanism having a platform assembly for permitting personnel to stand or ride to raise the personnel to an elevated level or lower the personnel to a lower or ground level, the vertical displacement mechanism also having an electronic controller, including position limit switches, proximity switches, and sensors;

and a folding steps assembly also attached to the main frame, the folded steps assembly having steps and an electromechanical means for folding the steps so that the steps are displaceable to, from and between a folded up configuration and a folded down configuration;

the folded up configuration permitting the steps to be folded up to a retracted, out of the way position when the platform assembly is raised or lowered, the folded up configuration blocking access to the ground-based structures, vehicles, and mobile equipment, and allowing the vertical displacement mechanism to freely move upwardly and downwardly without interference by the steps, thereby blocking the folding steps assembly from unauthorized use;

the folded down configuration securing the steps in place, the folded down configuration being a default configuration that permits ingress and egress of persons to or from the ground-based structures, vehicles, and mobile equipment;

the platform assembly being configured to be deployable within an area circumscribed by the folding steps.

2. The access platform system of claim 1, wherein the default configuration requires no electrical power.

3. An access platform system for facilitating access to and egress from ground-based structures, vehicles, and mobile equipment, the system having:

a main frame;

a vertical displacement mechanism attached to the main frame, the vertical displacement mechanism having left and right sides and a platform assembly, the vertical displacement mechanism further comprising a left intermediate carriage assembly, a right intermediate carriage assembly, a left lift cylinder having a stroke, and a right lift cylinder having a stroke; and a two-stage apparatus for influencing the stroke of the lift cylinders, one or more roller chains that guide the platform assembly, the chains engaging sprockets mounted on the left and right intermediate carriage assemblies which move together at a same speed and through a same vertical distance under the influence of the left and right lift cylinders, the chains and sprockets moving within the intermediate carriage assemblies, thereby influencing speed and travel range of motion of the vertical displacement mechanism so that travel speed and motion of the lift cylinders are equalized by controlling the pressure or flow of fluid provided to the lift cylinders, or by controlling the pressure and flow of fluid provided to the lift cylinders, so that the platform assembly advances upwardly at twice the speed as that of the intermediate carriage assemblies and the platform assembly lowers at twice the speed as that of the lift cylinders, and so that the lift cylinders and the intermediate carriage assemblies work together to simultaneously raise and lower the platform assembly;

the left and right sides of the vertical displacement mechanism permitting free vertical movement, mechanical alignment and guidance during relative motion of the assemblies during operation;

a folding steps assembly having folding steps attached to the main frame, the folding steps assembly also having a folded up configuration that allows the vertical displacement mechanism to move upwardly and downwardly without interference by the steps, the folded up position blocking access to the ground-based structures, vehicles, and mobile equipment; and a folded down configuration in which the steps are secured in place, the folded down configuration representing a default configuration that requires no electrical power to position the steps in the folded down configuration and permit ingress and egress of persons to or from the ground-based structures, vehicle, and mobile equipment in the event that electrical power is interrupted;

the platform assembly being configured to be deployable within an area circumscribed by the folding steps.

4. The access platform system of claim 3, wherein the steps have a width that lessens with height above the ground.

5. The access platform system of claim 3, further having an electromechanical means for folding and unfolding the steps, the electromechanical means including an electrical circuit that is closable by a control switch, thereby activating a steps control assembly.

* * * * *